United States Patent [19]

Radcliffe

[11] Patent Number: 4,942,662

[45] Date of Patent: Jul. 24, 1990

[54] ADJUSTABLE ARCUATE RAZOR HEAD

[76] Inventor: Allan F. Radcliffe, 12459 Floresta Ct., San Diego, Calif. 92128

[21] Appl. No.: 298,033

[22] Filed: Jan. 17, 1989

[51] Int. Cl.[5] ..... B26B 21/18; B26B 21/56

[52] U.S. Cl. ..... 30/49; 30/52; 30/346.55

[58] Field of Search ..... 30/47, 48, 49, 52, 53, 30/57, 58, 68, 69, 70, 346.55, 346.56

[56] References Cited

U.S. PATENT DOCUMENTS

| | | | |
|---|---|---|---|
| 1,798,447 | 3/1931 | Behrman | 30/49 |
| 1,821,825 | 9/1931 | Zumwalt | 30/49 |
| 1,974,568 | 9/1934 | Grotenhuis | 30/49 |
| 2,008,591 | 7/1935 | Ohmer | 30/49 |
| 2,060,520 | 11/1936 | Muros | 30/70 X |
| 3,407,496 | 10/1968 | Pomper | 30/49 |
| 4,459,744 | 7/1984 | Esnard | 30/49 |

*Primary Examiner*—Frank T. Yost
*Assistant Examiner*—Rinaldi Rada
*Attorney, Agent, or Firm*—Lewis E. Massie; David L. Baker

[57] ABSTRACT

The safety razor has an axial control rod that may have three detenting positions in the handle to define the movement up or down of the rod which arcuately bends at least one razor blade and a razor blade support plate in which the razor blade or blades are placed longitudinally into a convex curve, a straight blade or a concave curve providing a choice of arcuate cutting edges for a smooth shave over irregular surfaces of the portions of the body being shaved.

8 Claims, 1 Drawing Sheet

ADJUSTABLE ARCUATE RAZOR HEAD

BACKGROUND OF THE INVENTION

1. Field of the Invention

This invention relates to razor heads wherein the razor blade and razor blade support plate is bent to provide a selection of inclined arcuate surfaces such as a convex, a straight or a concave cutting edge allowing a choice of arcuate cutting edges to provide a smooth shave over irregular surfaces of the portion of the body being shaved.

2. Description of Related Art

The prior art describes several approaches to the problem of closely shaving convex and concave surfaces of the skin. U.S. Pat. No. 1,324,010 Hyman, describes a rigid, straight edged razor employing a square shaped blade having four cutting edges of different curvature two straight edges, a concave edge and a convex edge. U.S. Pat. No. 4,208,791 Van Cleve, describes an arcuate head safety razor shaped to conform to convex and concave body surfaces. The two separate cutting edges on inclined surfaces one above the other. Other prior art designs include a method of clamping one edge of a safety razor blade to remain straight while the other end was mechanically distorted to provide an arcuate edge.

SUMMARY OF THE INVENTION

It is an object of the present invention to provide a razor head utilizing the flexibility of the steel blade to adjust the longitudinal aspect of the straight edged, single or multi layered blade into either a convex or a concave or a straight surface by the longitudinal movement of an axial shaft in the razor head handle.

The invention relates to a safety razor with a means for receiving and wherein the means for receiving and bending bending at least one razor blade arcuately longitudinally and has a handle with a longitudinal axial bore. There is a razor blade support plate to hold at least one razor blade and the plate has a port in the body of the plate to receive a blade holding fixture. A rod is provided that extends through the axial bore of the handle to move the support plate and at least one razor blade to a concave, straight and convex configuration thereon and having the blade holding fixture on a first end of the rod to engage and hold the razor blade support plate and at least one razor blade.

There is a razor head on a end of the handle with a clip on a first end and on a second end of the razor head to hold at least one razor blade and the razor blade support plate. There is a grip fixture attached to the rod to move the rod.

There may be a first circumferential groove in an enlarged diameter bore in the axial bore of the handle and a compressive ring seated in the first circumferential groove. There may also be three axial second circumferential grooves on the outside circumference of the grip fixture to provide a detenting action as the movement of the rod in the axial bore of the handle allows the ring to engage one of the three second grooves providing three stops which cause the longitudinal edge of the support plate and at least one razor blade placed thereon to assume a concave, convex and straight configuration according to which groove of the second circumferential grooves is selected.

The safety razor may include a slot in the clip with a width in the slot sufficient to receive the razor blade support plate and at least one razor blade. The rod may be circular and be attached to the grip fixture. The clip may be spring loaded. The grip fixture may be a cylindrical finger fixture. A portion of the grip fixture may be slidably disposed within the enlarged diameter bore of the axial bore of the handle. The axial bore may be circular.

The invention may relate to a safety razor with means for receiving and bending at least one razor blade arcuately longitudinally and wherein the means for receiving and bending has a handle having a longitudinal axial circular bore with a bottom section of the bore having a portion of enlarged diameter. The enlarged diameter bore has a first circumferential groove on an inside circumference. There is a razor blade support plate to hold at least one razor blade and with a port in a body of the plate to receive a blade holding fixture.

There is a circular rod extending through the axial bore of the handle having a blade holding fixture on a first end of the circular rod to engage and hold the razor blade support plate and at least one blade and the circular has a cylindrical finger grip fixture attached to a second end of the circular rod. Included is a razor head on a first end of the handle with spring-loaded clips on a first and on a second end of the razor head to hold at least one razor blade and the razor blade support plate. There is a slot in the spring-loaded clips with a width of the slot sufficient to receive the razor blade support plate and at least one razor blade.

A portion of the cylindrical finger grip fixture is slidably disposed within the enlarged bore of the handle and the finger grip fixture has three axially spaced second circumferential grooves on the outside circumferential surface. There is a compressive ring seating in the first circumferential groove on the inside circumference of the enlarged diameter bore of the handle to provide a detenting action as the movement of the circular rod in the bore of the handle allows the ring to engage one of the three second circumferential grooves on the outside circumference of the finger grip fixture providing three axial stops which causes the longitudinal of the razor blade support plate at least one razor blade placed thereon to assume a concave, convex and straight configuration according to the groove in the finger grip fixture selected.

DETAILED DESCRIPTION OF THE PREFERRED EMBODIMENT

Figure 1:
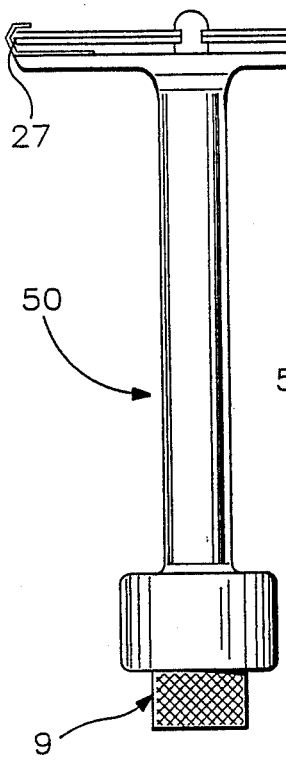
FIG. 1 is a front view of the adjustable arcuate razor head.
Figure 2:
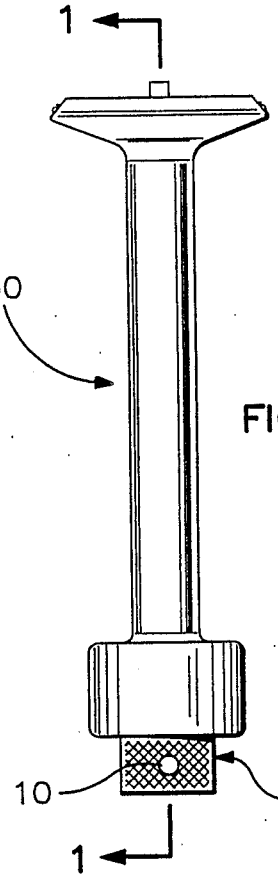
FIG. 2. is a side view of the adjustable arcuate razor head.

Referring to FIGS. 1, 2, 3, 4, 5, 6, and 7, it will be seen that a safety razor 50 is shown with a handle 1. Handle 1 has a longitudinal axial circular bore 21. The axial bore 21 and the rod 2 could be other than round. Axial bore 21 has an enlarged diameter bore 22 at a bottom section 23 of the axial bore 21. There is a first circumferential groove 24 on an inside circumference 25 of enlarged bore 22. The safety razor 50 could be built without the enlarged diameter bore 22 and the first groove 24 placed in the axial bore 21.

Figure 3:
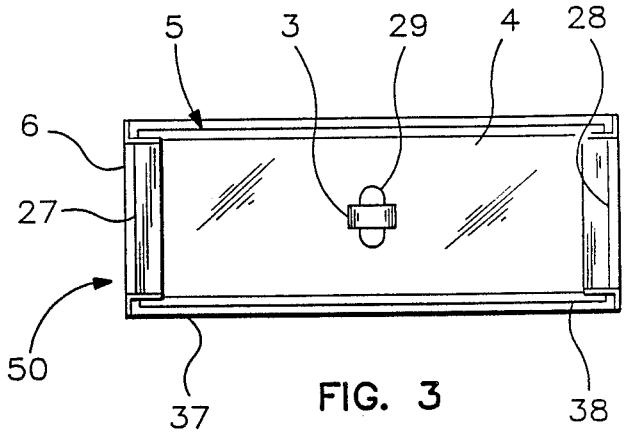
FIG. 3. is a top view of the adjustable arcuate razor head.
Figure 5:
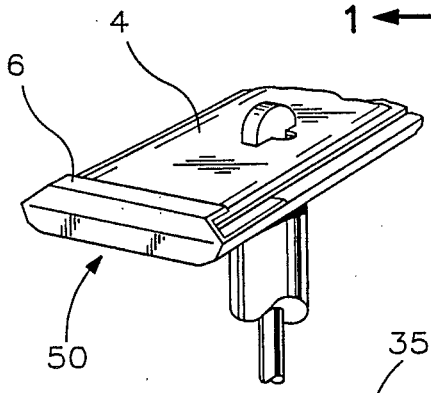
FIG. 5 is a fragmented perspective view of the blade holding fixture extending through and engaging the blade support plate and at least one blade.

The support plate 5 is capable of holding at least one razor blade 4 as shown in FIG. 3. The support plate 5 has a port 29 in the body 30 of the support plate 5. The razor blade may have a port in its body that, when the razor blade 4 is inserted into the razor blade support plate 5, will be aligned with the port 29 or the support plate itself may retain the blade or blades. The port 29 is configured to receive blade holding fixture 3 as particularly shown in FIGS. 3, 4 and 5. Blade holding fixture 3 is inserted into port 29 and into the port in at least one razor blade 4 with the long axis of the blade holding fixture aligned with the long axis of the ports. The blade holding fixture 3 is rotated by rotating cylindrical finger grip fixture 9 and circular rod 2 until the long axis of blade holding fixture 3 is aligned with the short axis of the ports thereby securing the support plate 5 and at least one razor blade 4 to the holding fixture 3 and thereby to circular rod 2.

In this embodiment, the circular rod 2 extends through the axial bore 21 of the handle 1. Rod 2 has the blade holding fixture 3 attached to a first end 39 of the rod 2 and has the grip fixture 9 attached to a second end 31 by pin 10. Rod 2 could be secured to grip fixture 9 by other means.

Figure 4:
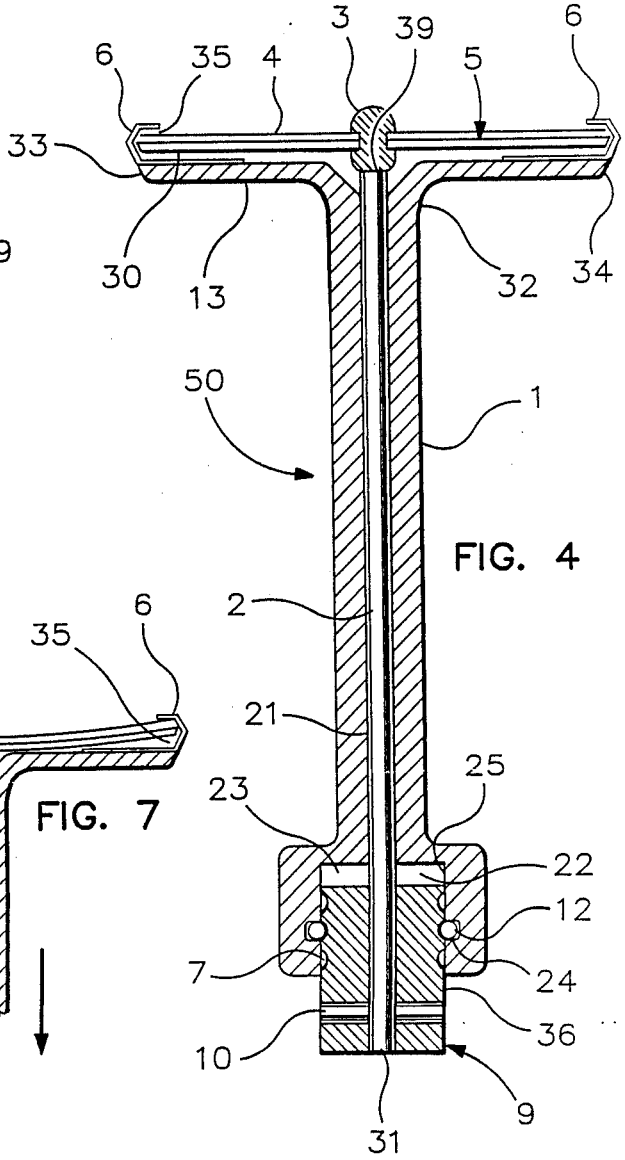
FIG. 4 is a cross sectional view through 1—1 of FIG. 2 showing the circular rod in a position that places the razor blade support plate and at least one razor blade in a straight configuration.
Figure 6:
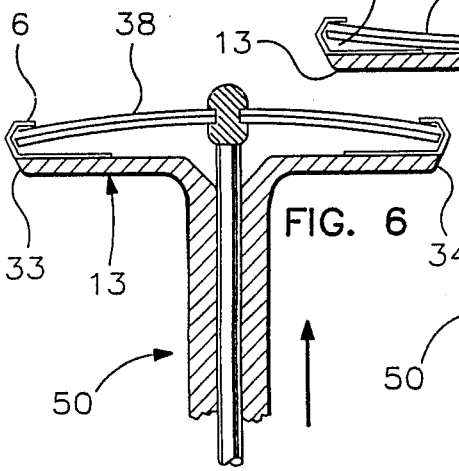
FIG. 6 is partial fragmented sectional view of the safety razor showing the circular rod in a position that bends the razor blade support plate and at least one razor blade in a concave configuration.
Figure 7:
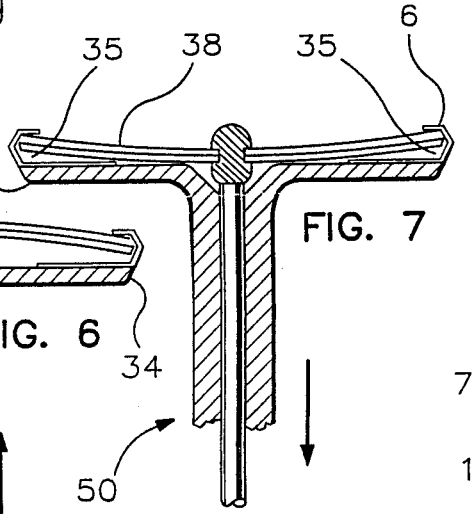
FIG. 7 is a partial fragmented sectional view of the safety razor showing the circular rod in a position that bends the razor blade support plate and at least one razor blade in a convex configuration.

There is a razor head 13 on the first end 32 of the handle 1. There is a clip 6 that could be spring-loaded on a first end 33 and on a second end 34 of the razor head 13 to hold at least one razor blade 4 and the support plate 5 as shown in FIGS. 4, 6 and 7. The slot 35, pointed out in FIGS. 4 and 7, in the clip 6 has a width sufficient to receive the support plate 5 and at least one razor blade 4. at least one razor blade 4 is placed in the support plate 5. The razor blade or blades and the support plate are then bowed slightly to shorten the distance between their ends (ends 27 and 28 of the support plate) and placed on the transverse bar 13 between the clips 6. The blade or blades and the support plate are allowed to straighten and the ends 27 and 28 are allowed to enter into the slot 35 of the clips 6.

The grip fixture 9, which may be a cylindrical finger grip although the grip fixture does not have to be circular, has in this embodiment, a portion of its body slidably disposed within the enlarged diameter bore 22 of the handle 1. The length and shape of finger grip 9 may vary according to manufacturing specifications. The finger grip fixture 9 has three axially spaced circumferential grooves 7 on the outside circumferential surface 36. There is a compressive ring 12 seating in the first circumferential groove 24 on the inside circumference 25 of the enlarged diameter bore 22 of the handle 1. The ring 12 could be an O-ring, spring ring or the like.

As the grip fixture 9 slidably moves the rod 2 relative to the handle 1 within the enlarged diameter bore 22, the ring 12 is compressed into first groove 24 and then expands into the next second circumferential groove 7. This provides a detenting action as the finger grip 9 and the circular rod 2 move back and forth and relative to the handle 1. This provides three axial stops which cause the longitudinal edge 37 of the razor blade support plate 5 and the longitudinal edge 38 of at least one razor blade 4 placed therein to assume a concave, convex or a straight configuration according to the second circumferential groove 7 on the finger grip fixture 9 selected. See FIGS. 4, 6 and 7.

I claim:

1. A safety razor with means for receiving and bending at least one razor blade arcuately longitudinally wherein the means for receiving and bending comprises:

a. a handle having a longitudinal axial circular bore;

b. a bottom section of the bore having a portion of enlarged diameter;

c. the enlarged diameter bore having a circumferential groove on an inside circumference;

d. a razor blade support plate to hold at least one razor blade and with a port in a body of the plate to receive a blade holding fixture;

e. a circular rod extending through the axial bore of the handle having the blade holding fixture on a first end of the circular rod to engage and hold the razor blade support plate and at least one blade and having a cylindrical finger grip fixture attached to a second end of the circular rod;

f. a razor head on a first end of the handle with a spring-loaded clip on a first end and on a second end of the razor head to hold at least one razor blade and the razor blade support plate;

g. a slot in the spring-loaded clip with a width of the slot sufficient to receive the razor blade support plate and at least one razor blade;

h. a portion of the cylindrical finger grip fixture slidably disposed within the enlarged bore of the handle;

i. the finger grip fixture having three axially spaced circumferential grooves on the outside circumferential surface; and j. a compressive ring seating in the circumferential groove on the inside circumference of the enlarged diameter bore of the handle to provide a detenting action as the movement of the circular rod in the bore of the handle allows the ring to engage one of the three circumferential grooves on the outside circumference of the finger grip fixture providing three axial stops which causes the longitudinal edge of the razor blade support plate and at least one razor blade placed thereon to assume a concave, convex and straight configuration according to the groove in the finger grip fixture selected.

2. A safety razor with means for receiving and bending at least one razor blade arcuately longitudinally wherein the means for receiving and bending comprises:

a. a handle having a longitudinal axial bore;

b. a razor blade support plate to hold at least one razor blade and having a port in a body of the plate to receive a blade holding fixture;

c. a rod extending through the axial bore of the handle to move the support plate and at least one razor blade to a concave, straight and convex configuration thereon and having the blade holding fixture on a first end of the rod to engage and hold razor blade support plate and at least one razor blade;

d. a razor head on a first end of the handle with a clip on a first end and on a second end of the razor head to hold at least one razor blade and the razor blade support plate; and e. a grip fixture attached to the rod to move the rod.

3. A safety razor as defined in claim 2 further comprising:

a. an enlarged diameter bore in the axial bore of the handle;

b. a first circumferential groove in the enlarged bore;

c. a compressive ring seated in the first circumferential groove; and d. three axial second circumferential grooves on the outside circumference of the grip fixture to provide a detenting action as the movement of the rod in the axial bore of the handle allows the ring to engage one of the three second grooves providing three stops which cause the longitudinal edge of the support plate and at least one razor blade placed thereon to assume a concave, convex and straight configuration according to which groove of the second circumferential grooves is selected.

4. A safety razor as defined in claim 2 further comprising:

a. a slot in the clip with a width of the slot sufficient to receive the razor blade support plate and at least one razor blade; and b. the rod being circular and being attached to the grip fixture.

5. A safety razor as defined in claim 4 wherein the clip is spring-loaded.

6. A safety razor as defined in claim 2 wherein the grip fixture is a cylindrical finger grip fixture.

7. A safety razor as defined in claim 2 further comprising:

a. an enlarged bore in the axial bore of the handle; and b. a portion of the grip fixture slidably disposed within the enlarged diameter bore of the axial bore of the handle.

8. A safety razor as defined in claim 2 wherein the axial bore is circular.

* * * * *